US005374163A

United States Patent [19]

Jaikaran

[11] Patent Number: 5,374,163

[45] Date of Patent: Dec. 20, 1994

[54] DOWN HOLE PUMP

[76] Inventor: Allan Jaikaran, 136 Crest Camp, Fyzabad, Trinidad/Tobago

[21] Appl. No.: 60,872

[22] Filed: May 12, 1993

[51] Int. Cl.[5] ..... F04F 5/00

[52] U.S. Cl. ..... 417/172; 417/197; 166/68; 166/105; 166/106

[58] Field of Search ..... 166/68, 105, 106, 187, 166/319, 222, 223; 417/172, 197, 151

[56] References Cited

U.S. PATENT DOCUMENTS

| | | | |
|---|---|---|---|
| 2,909,127 | 10/1959 | Bradaska | 417/172 |
| 3,795,367 | 3/1974 | Mocarski | 417/197 X |
| 4,090,814 | 5/1978 | Teodorescu et al. | 417/197 X |
| 4,171,016 | 10/1979 | Kempton | 166/68 |
| 4,186,772 | 2/1980 | Handleman | 417/197 X |
| 4,192,461 | 3/1980 | Arborg | 417/197 X |
| 4,293,283 | 10/1981 | Roeder | 166/106 X |
| 4,310,288 | 1/1982 | Erickson | 417/172 X |
| 4,322,897 | 4/1982 | Brassfield | 417/197 X |
| 4,444,253 | 4/1984 | Smith et al. | 417/172 X |
| 4,448,354 | 5/1984 | Reznick et al. | 417/197 X |
| 4,630,691 | 12/1986 | Hooper | 166/187 X |
| 4,718,486 | 1/1988 | Black | 166/68 |
| 4,726,420 | 2/1988 | Weeks | 166/68 |
| 4,790,376 | 12/1988 | Weeks | 166/68 |
| 4,846,280 | 7/1989 | Snider | 166/319 X |
| 5,083,609 | 1/1992 | Coleman | 166/68 |

*Primary Examiner*—Roger J. Schoeppel
*Attorney, Agent, or Firm*—Gunn & Kuffner

[57] ABSTRACT

A down-hole pump provides positive displacement pump action within a production string of a producing well. The insert pump of the present invention fits within a crossover nipple that is adapted to fit on the end of a production string. The pump seals within an intermediate casing to direct high pressure drive fluid into the pump. The drive fluid directed into the pump passes through a nozzle segment of the pump to develop a high velocity annular flow region. Production fluid is drawn into the nozzle segment at the *Vena Contracta* of the nozzle to develop the maximum entrainment force by the drive fluid. The combined flow of the drive and production fluids is then directed into a Venturi segment that creates a vacuum condition to increase production flow from the producing structures.

14 Claims, 4 Drawing Sheets

FIG. 9
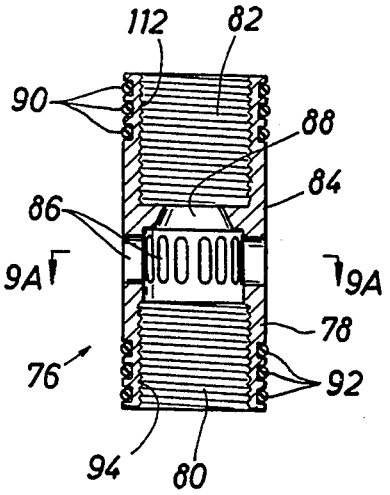
FIG. 11
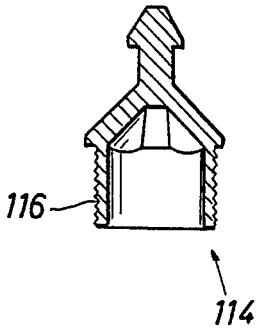
FIG. 10
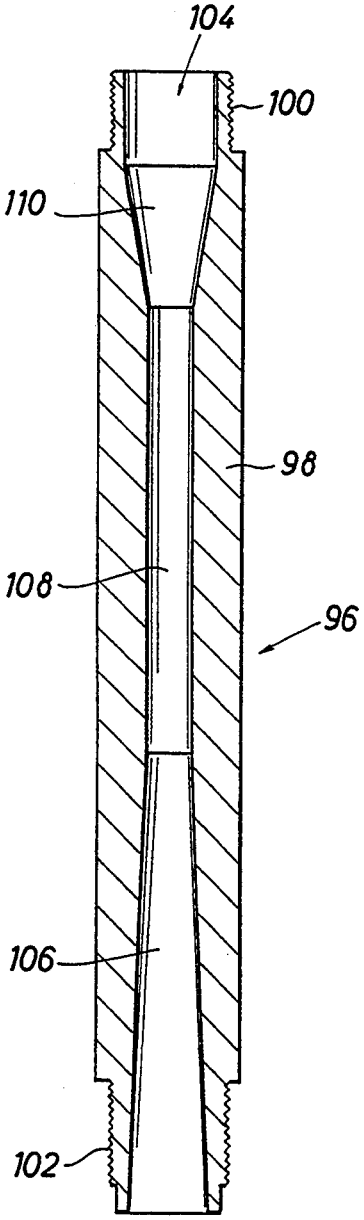
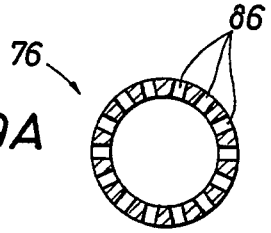
FIG. 9A
FIG. 4
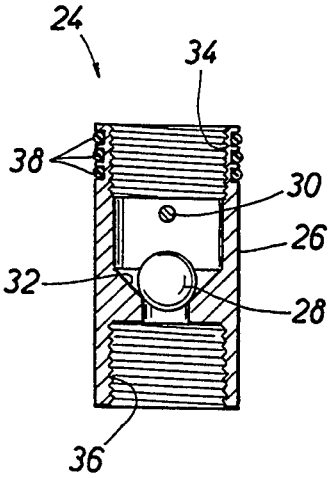
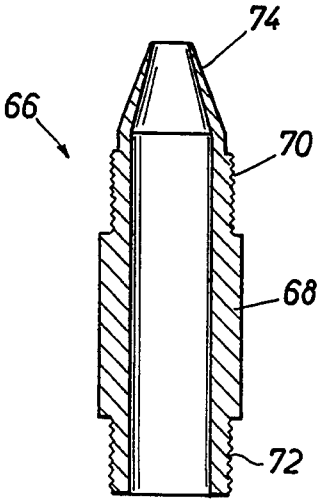
FIG. 8

FIG. 13
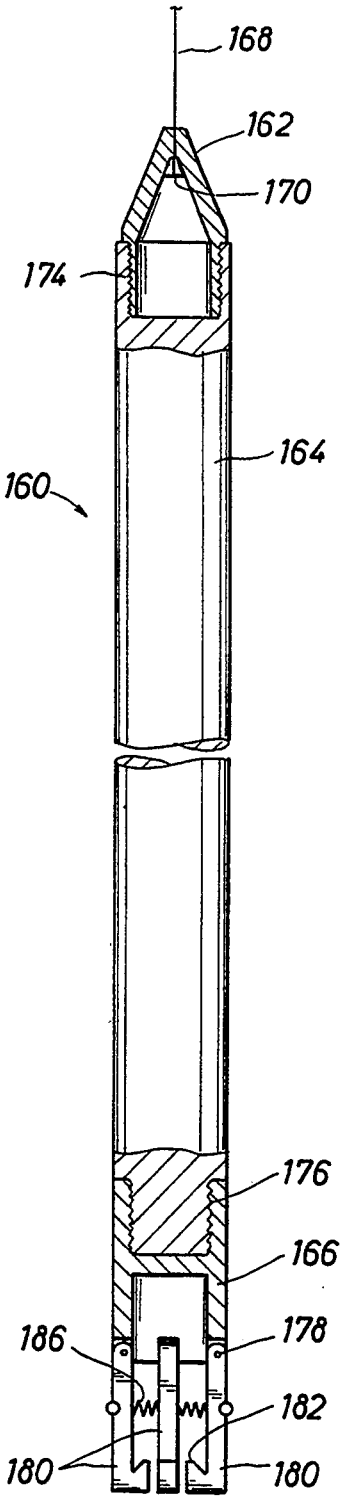
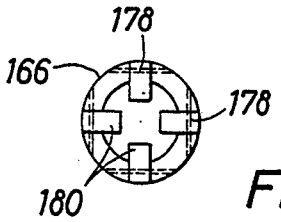
FIG. 13A
FIG. 13B
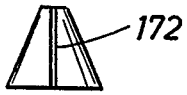
FIG. 13A
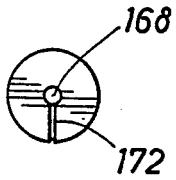
FIG. 14
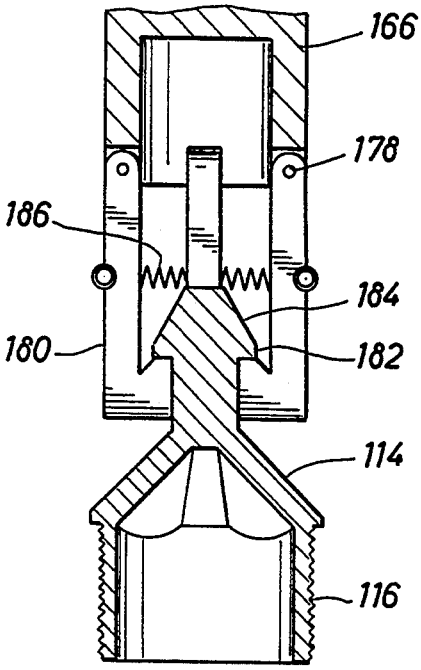

DOWN HOLE PUMP

FIELD OF THE INVENTION

The present invention relates generally to the field of down hole pumping apparatus and, more particularly, to a venturi-type, positive displacement pump for withdrawing oil or other production fluid from producing structures.

BACKGROUND OF THE INVENTION

Certain industries, such as the oil and gas industry, need pumps to pump fluids from a well when the down hole pressure is insufficient to force fluids to the surface. Such industries employ a variety of methods and pumps to pump out wells. For example, some applications employ a rod pump which uses a reciprocating motion to develop a pumping force. Unfortunately, a rod pump develops a pumping force only on the down stroke. In other words, the pump only pumps half the time, that during the down stroke. During the upstroke, the pump barrel of the rod pump is refilled. Also, the volume of liquid that is pumped by a rod is that constrained within the pump barrel and is limited to the displacement of the pump.

Rod pumping, although widely used, suffers from several other drawbacks. For the pump to operate properly, the pump has to be submerged in the liquid being pumped at all times during normal operation. In oil production, whenever the pump is not submerged in the liquid being pumped, the pump sucks in natural gas and it "gas-locks". When the pump "gas-locks," it ceases to do productive work. Because of the close tolerances within the pump and the absence of liquids being pumped, the liquids being pumped lubricate the sliding surfaces within the pump. With the pump empty of any liquids, friction causes the pump to fail. The failure is not immediate but takes place with time. If the "gas lock" condition is discovered early, the pump is stopped, the rods with the internal reciprocating section of the pump are slowly lowered until the reciprocating section within the pump touches an internal check valve. This action compresses natural gas in the pump and can force it out of the pump. The rod is then reset to a new position. The pump is started and checks are made to ensure that the reciprocating internal section of the pump is not striking the internal check valve. This method is called "re-spacing" the pump. This method generally works, but normally the pump does not work at the original programmed rate because the internal wear in the pump increases the tolerances between the reciprocating parts and the consequent increase in slippage of the produced liquids. If "re-spacing" the pump fails, a rod job is required which requires a workover rig.

Another problem with rod pumping is that the pump cannot tolerate produced sand in the liquid that is being pumped. Because of the close tolerances between the plunger and the barrel of the pump, sand causes the plunger of the pump to freeze in the pump barrel. When this happens, the pump ceases to do productive work and a rod job is required to restore production.

In addition to the above problems associated with rod pumps, as the rod and pump accelerates from stop, moving from the upstroke to the down-stroke, and under the force of gravity, the weight and acceleration of the rods and pump during the down-stroke causes an extension which is similar to the extension of a weight on a spring. This extension causes a pounding of the pump on the tubing string. The pounding on the tubing string causes the tubing string to also act as a weight on a spring. If the extensions of the rods and pump on one part and the tubing string on the other part are in phase, the tubing can quickly fail. If the forces are out of phase, the hammering on the tubing string eventually causes the tubing string to leak. If a leak develops due to vibration and/or fatigue, an expensive workover of the production rig is required to restore production.

Another restriction of this type of operation is that rod pumping is limited to straight holes and slightly deviated holes. With the use of rod guides some greater deviation of the hole from vertical can be tolerated. However, a rod pump cannot be used for high angle or horizontal wells.

Also, production is enhanced by increased the pressure differential between production strata and the well bore. However, a rod pump requires submergence and the head of fluid required by the submergence is a positive pressure on the well bore, which significantly limits the rate of producing an oil well.

Another type of pump for pumping fluids from down hole is a rotary rod pump. A rotary rod pump is a progressive cavitation pump which has a rotation motion. The rotary motion is transmitted from a surface motor to the pump via normal sucker rods. This pump is somewhat more efficient than the rod pump and can tolerate some sand and natural gas. But, it is not suitable for highly deviated or horizontal wells or in wells with high gas/liquid ratios or in which formation sand is constantly produced in association with the produced liquid. The rotary rod pump also suffers wear on the rod coupling/tubing area in areas where the rods are in contact with the tubing.

Some applications for withdrawing fluids from down hole call for jet pumping. Jet pumping creates a low pressure area to which the produced liquids migrate, to trap and accelerate the fluid. Jet pumps can handle natural gas without gas lock. Also, jet pumps can reduce the well bore pressure to pressures below normal atmospheric. Unfortunately, known jet pumps cannot handle large quantities or slugs of produced sand. They easily sand up because of the close tolerances through which the production fluids must pass.

Developing well bore pressures below normal atmospheric is important to well performance. The inflow performance of an oil well is dependent upon the pressure differential between the reservoir pressure and the well bore pressure. Thus, the greater the pressure difference, the greater the inflow into the well bore. Vacuum conditions on the well bore provides the highest pressure differential.

In the initial migration of oil from the source rock through cracks and faults to a lower pressure permeable reservoir rock, normally the higher pressure oil would force out water from the reservoir rock and so displace it that the only remaining water would be that water coating the individual sandstone matrix that comprises the reservoir rock. When an oil well is drilled to the reservoir rock, and as oil is produced, the cavity formed when the oil is produced is now taken up with natural gas that comes out of solution from the oil. A drop of oil surrounded by natural gas in a sandstone reservoir, which was initially water wet, has an extremely high surface tension. There is a point in the production of an oil well normally at the time when 15% to 20% of the original oil in place has been produced, especially with reservoirs where the drive mechanism is a secondary gas cap, the oil well cannot be economically produced using known artificial lift techniques. Artificial lift techniques include but are not limited to pumping, i.e., using one of the methods previously described, or gas lift, in which gas is injected into the production string to aerate the column of oil, thereby producing the oil. To produce additional oil at an economic rate, secondary recovery is required. Such currently used secondary recovery techniques include gas injection, surfactant injection, water injection, steam flood, and in situ combustion. At the point in time when it is uneconomic to artificially lift oil wells, the problem is the migration of oil from within the reservoir to the well bore. The oil has a very difficult time getting to the well bore, since it has to pass through the pore spaces in the sandstone matrix and the higher the surface tension between the oil and natural gas interface and the natural gas and the water interface, the lower is the inflow to the wellbore, and the lower is the oil production. It is actually possible for low levels of oil production to occur early in the producing life of the well. It would be advantageous to use an artificial lift technique that develops a vacuum in the well bore to increase the in flow of oil from the formation into the well bore as well as lift the oil at the same time.

Therefore, there remains a need for a down hole pump that can pump liquids, gases, and solids together or individually. Such a pump should not cause or create a rubbing action or a jarring action which may damage the tubing string. Such a pump must also be capable of pumping in highly deviated and/or horizontal wells. A down hole pump ideally pumps 100% of the time, not just on the down stroke as in a rod pump. Such a down hole pump should also be capable of producing vacuum conditions at the well bore or sand face of the reservoir rock. The pumping rate of such a pump should also be capable of being adjusted by using a simple mechanism.

In addition, cost effectiveness of the production operation would be improved if the pump were run down hole initially on the completion string or the completion string were filled with adapters to later accommodate the pump which would then be run into the well using wireline tools and equipment. By running the pump in the well on the initial completion string, the well could be produced earlier than normal because the rig pump can be used with water to circulate out the drilling fluids and induce flow. Also, when the well stops flowing, artificial lift can immediately commence with no interference to the tubing string.

SUMMARY OF THE INVENTION

The down hole pump of the present invention provides these and other advantages over known down-hole pumps. The pump of the present invention fits within a crossover nipple that is adapted to fit on the end of a production string. The pump seals within an intermediate casing to direct high pressure drive fluid into the pump. The drive fluid directed into the pump passes through a nozzle segment of the pump to develop a high velocity annular flow region. Production fluid is drawn into the nozzle segment at the *Vena Contracta* of the nozzle to develop the maximum entrainment force by the drive fluid. The combined flow of the drive and production fluids is then directed into a Venturi segment that creates a vacuum condition to increase production flow from the producing formation.

The structure of the pump of the present invention provides the further advantage of having no moving parts in the pump action to eliminate pump failures due to wear and fatigue. This structure is far more forgiving to sand-laden production fluid. Also, since the pump is adapted to fit the end of a production string, the pump can be run into the well upon completion of drilling operations and artificial lift may commence immediately when down-hole pressure dictates. This eliminates the costly change over to secondary recovery normally required.

These and other objects and features of the present invention will be apparent to those of skill in the art when they read the following detailed description in conjunction with the drawing figures.

BRIEF DESCRIPTION OF THE DRAWINGS

FIG. 4 is a section view of the upper check valve segment of the down hole pump.

FIG. 8 is a section view of the nozzle segment of the liquids being pumped by the down hole pump.

FIG. 9 is a section view of the drive fluid injection segment of the down hole pump.

FIG. 9A is a section view of the drive fluid injection segment of FIG. 9.

FIG. 10 depicts a section view of the Venturi section of the down hole pump.

FIG. 11 depicts a section view of a retrieval nipple end segment of the down hole pump.

FIG. 13 depicts a section view of the retrieval tool end segment, which is used to retrieve the down-hole pump by latching onto the retrieval nipple shown in FIG. 11.

FIG. 13A is a view looking under the retrieval tool showing the latching device.

FIG. 13B is a view showing the mechanism used to locate and hold the piano wire line in the retrieval tool.

FIG. 13C is a plan view of FIG. 13B.

FIG. 14 depicts the retrieval tool grasping the retrieval nipple.

DETAILED DESCRIPTION OF A PREFERRED EMBODIMENT

The following detailed description details the various components that make up the down-hole pump of the present invention, describes the assembled pump in its intended environment, and then describes fluid flow of actuation fluid and produced fluid in an operating pump. Finally, the detailed description details a fishing tool for retrieval of the pump.

Figure 3:
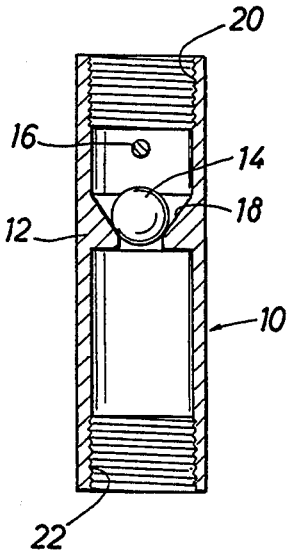
FIG. 3 is a section view of the lower check valve segment of the down hole pump.

FIG. 3 depicts a check valve segment 10, which permits upward vertical flow of fluid and prevents downward flow, as viewed in FIG. 3. The check valve segment 10 includes a substantially cylindrical body 12, a check ball (standing valve) 14, and a retaining pin 16, which determines the maximum upward movement of the check ball 14. Within the cylindrical body, a check valve seat 18 supports the check ball in its quiescent state. The check ball 14 and the check valve seat 18 are preferably of a very hard material, such as chrome steel, to reduce wear or damage from the fluids such as by abrasion and cavitation.

The cylindrical body 12 also includes an upper inside threaded section 20 and a lower inside threaded section 22, to couple the check valve segment to adjacent segments of the pump.

FIG. 4 depicts a similar check valve segment 24, which permits upward vertical flow of fluid and prevents downward flow, as viewed in FIG. 4. The check valve segment 24 includes a substantially cylindrical body 26, a check ball (standing valve) 28, and a retaining pin 30, which determines the maximum upward movement of the check ball 28. Within the cylindrical body, a check valve seat 32 supports the check ball in its quiescent state. The check ball 28 and the check valve seat 32 are preferably of a very hard material, such as chrome steel, to reduce wear or damage from the fluids such as by abrasion and cavitation.

The cylindrical body 26 also includes an upper inside threaded section 34 and a lower inside threaded section 36, to couple the check valve segment to adjacent segments of the pump. The check valve segment 24 of FIG. 4, unlike the check valve segment 10 of FIG. 3, includes a set of O-rings 38 to seal off the valve against a production string as explained below. The O-ring seals 38 prevent any solids in the mixture of produced fluid and spent high pressure drive fluid from settling in the area between the pump and the tubing, and thereby to allow easy movement of the pump during retrieval.

Figure 6:
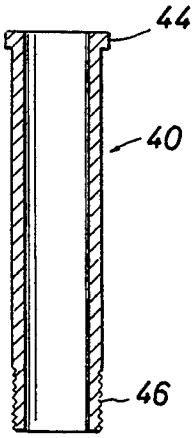
FIG. 6 is a section view of the top section of the slide column of the down hole pump.
Figure 5:
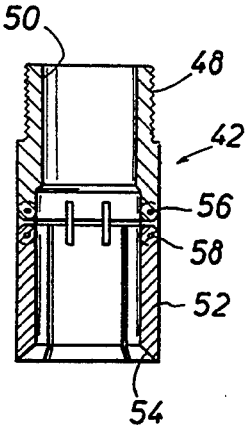
FIG. 5 depicts a section view of a latch segment of the down hole pump.

A slide column 40, shown in FIG. 6, slides into a latch segment 42, shown in FIG. 5. The slide column 40 includes an upper retaining flange 44 and a lower threaded portion 46. The latch segment 42 into which the slide column 40 slides, includes an upper threaded section 48, an internal bore 50 to receive the slide column 40, and a hinged latch section 52. The latch segment 42 also includes a beveled lower edge 54.

Figure 5A:
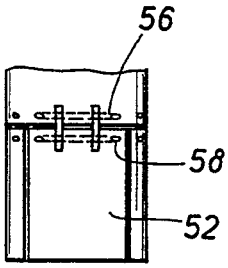
FIG. 5A provides details of the latch elements of the latch segment of FIG. 5.

FIG. 5A provides details of the structure of the hinged latch section 52. Pivots 56 on the upper part of the hinged latch section 52 are each riveted in place to provide free movement of the latches as described below.

Figure 7:
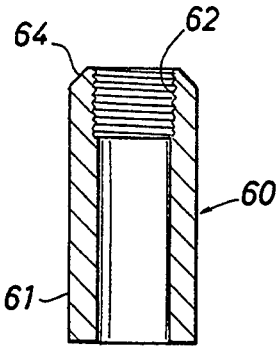
FIG. 7 is a section view of the bottom section of the slide column of the down hole pump.

Once the slide column 40 is inserted into the bore 50 of the latch segment 42, a cam segment 60, shown in FIG. 7, attaches to the slide column 40 by a section of threads 62 and 46, for example, although any attaching means may be used. The cam segment 60 also includes a beveled edge 64 that spreads the latch sections 5 2 apart. The internal bevel 54 of the latch segment allows the slide column 40 easy upward motion as it abuts the bevel edge 64 of the cam segment.

With the slide column 40 attached to the cam segment 60, the latch segment 42 of FIG. 5 is free to move along the slide column 40 approximately 2.75 inches, for example. As the pump is (later) inserted down-hole for operations, the beveled edge 54 of the latch segment abuts the beveled edge 64 of the cam segment 60 of FIG. 7, and the latch sections 52 slide down the exterior surface of the cam segment 60 of FIG. 7 to actuate the latch as explained below.

Next, the latch segment 42 of FIG. 5 attaches to the bottom of the lower check valve segment 10 of FIG. 3, by, for example, threaded portions 48 and 22.

The pump of the present invention also includes a nozzle segment 66, shown in FIG. 8. The nozzle segment 66 includes a substantially cylindrical body 68 with an upper threaded portion 70 and a lower threaded portion 72. Above the upper threaded portion 70 extends to a taper nozzle 74. The nozzle segment 66 of FIG. 8 attaches to the lower check valve 10 of FIG. 3, by, for example, screwing the lower threaded portion 72 of the nozzle segment 66 into the upper threaded portion 20 of the lower check valve 10.

A drive fluid injection segment 76 of FIG. 9 includes a substantially cylindrical body 78 that defines a suction chamber 80 and a discharge chamber 82. The suction chamber 80 and discharge chamber 82 are further defined by a divider plate 84 above a plurality of slots 86 in the suction chamber 80. The divider plate 84 also includes a nozzle opening 88 to receive the taper nozzle 74 of FIG. 8, as the pump is assembled. The slots 86 into the suction chamber receive high pressure fluid from an external source (not shown) to actuate the pump. The slots 86 are uniformly spaced about the circumference of the drive fluid injection segment as shown in the section view of FIG. 9A. A set of O-rings 90 and 92 seal the drive fluid injection segment to prevent high pressure fluid from by-passing the pump.

The drive fluid travels down the annulus formed between the intermediate casing and the production string. The cross-sectional area of the annulus between the intermediate casing and the production string is large in comparison to the cross-sectional area of the slots in the cross-over nipple and the drive fluid injection segment. Upon assembly, the slots in the cross-over nipple would coincide with the slots in the drive fluid injection segment. The cross-sectional area of the slots 86 in the drive fluid injection segment is great in relation to the cross-sectional area formed by the nozzle 74 of the nozzle segment and the nozzle opening 88 of the drive fluid injection segment. The velocity of the high pressure fluid used to actuate the pump is inversely proportional to the cross-sectional area. Thus the larger the cross-sectional area, the lower would be the velocity of the high pressure fluid used to actuate the pump. It is important to keep velocities low because there is a pressure or energy loss when pumping high pressure fluid used to actuate the pump, and the pressure or energy loss is directly proportional to the velocity of the fluid. The only area where the high pressure fluid is accelerated to a high velocity is in the cross-sectional area formed by the nozzle 74 and the nozzle opening 88. As the high pressure fluid travels through the nozzle formed between the nozzle 74 and the nozzle opening 88, the high pressure fluid is accelerated through the ever decreasing cross-sectional area formed between the nozzle 74 and the nozzle opening 88. The pressure energy is converted to velocity energy, and the velocity energy is greatest at the *Vena Contracta.*

The drive fluid injection segment 76 of FIG. 9 couples to the nozzle segment 66 of FIG. 8 by, for example, screwing them together at the upper threaded portion 70 of the nozzle segment 66 and the lower threaded portion 94 of the drive fluid injection segment 76. Once in place, the taper nozzle 74 of the nozzle segment 66 protrudes through the nozzle opening 88 by about 0.25 inches, for example.

The pump further includes a Venturi pump segment 96 shown in FIG. 10. The Venturi pump segment 96 comprises a generally cylindrical body 98 with a set of upper threads 100 and a set of lower threads 102. The Venturi pump segment 96 further includes a bore 104 of varying diameter. A lower bore 106 has a decreasing diameter and serves as an acceleration region of the pump in which drive fluid with production fluid entrained accelerates in velocity. A cylindrical bore 108 serves as a constant velocity region and mixing region, while an upper bore 110, with an increasing diameter serves as an energy recovery region in which fluid velocity decreases, creating a pumping force for the fluid.

The Venturi pump segment 96 of FIG. 10 is threadedly coupled to the drive fluid injection segment 76 of FIG. 9 at the threads 102 and a set of upper threads 112 in the drive fluid injection segment 76. The check valve segment 24 of FIG. 4 couples to the Venturi pump segment 96 by threads 36 and 100. Finally, a retrieval nipple end segment 114 shown in FIG. 11 couples to the check valve segment 24 by threads 34 and 116 to complete assembly of the pump.

Figure 12:
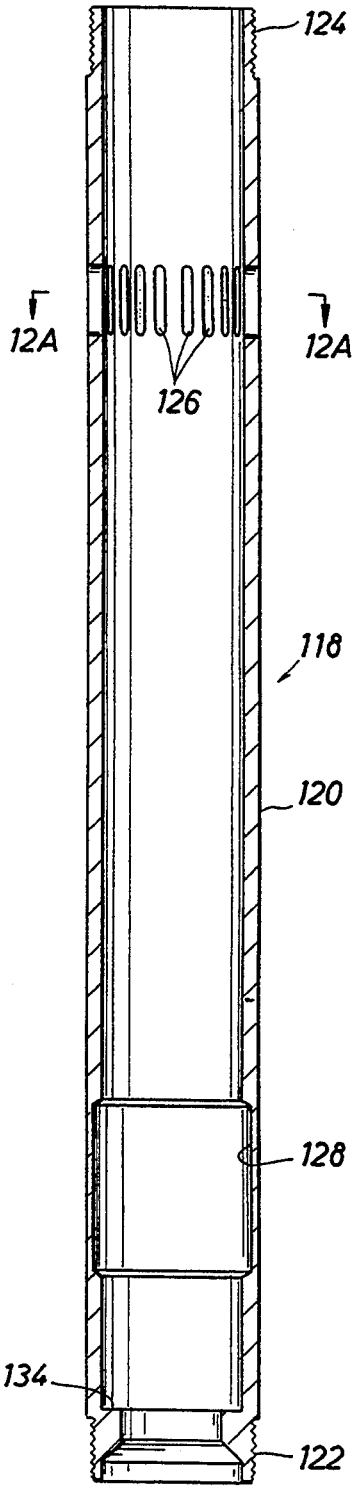
FIG. 12 depicts a section view of a crossover nipple adapted to receive an assembled down hole pump of the present invention.
Figure 12A:
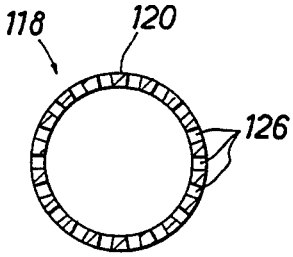
FIG. 12A is a section view showing inlet slots of the crossover nipple of FIG. 12 to handle the drive fluid injection.

The assembled pump fits within a cross-over nipple 118 shown in FIG. 12. The cross-over nipple 118 comprises a generally cylindrical body 120 with lower threads 122 and upper threads 124. The cross-over nipple also includes a plurality of inlet slots 126, evenly spaced about the circumference of the body 120, as shown in the section view of FIG. 12A.

The cross-over nipple also includes a recess 128. The recess 128 receives the latch section 52 of FIGS. 5 and 5A. When the latch section 52 rides up on the exterior surface of the keeper 60 of FIG. 7 by the cam action created by the bevel section 64 of the cam segment, the latch section expands into the recess 128 to latch the pump into place within the cross-over nipple.

Figure 1:
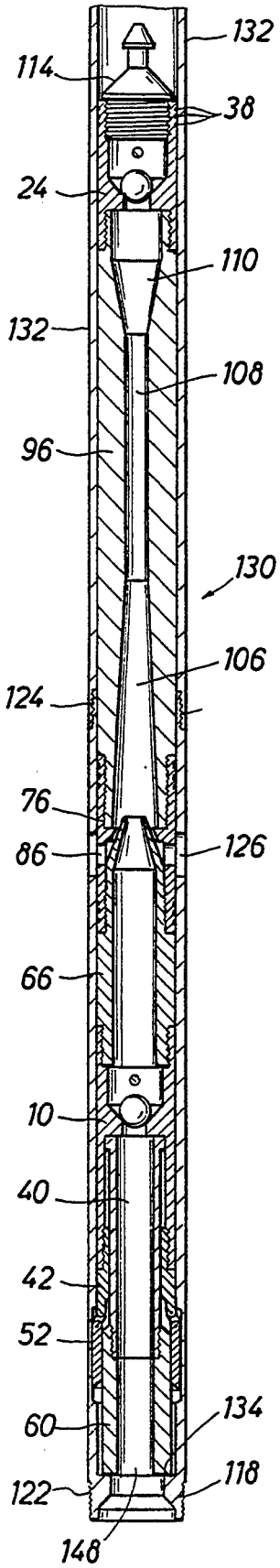
FIG. 1 depicts a section view of a down hole pump of the present invention located within a crossover nipple attached to the lower end of a production string.

FIG. 1 depicts an assembled pump 130 within the cross-over nipple 118 attached to the lower end of a production string 132. The production string 132 attaches to the cross-over nipple 118 at threads 124. The cam segment 60 forms the lower most extremity of the pump 130 and abuts the bottom ledge 134 of the cross-over nipple 118. The latch sections 52 have spread and now encase the exterior surface of the cam segment 60. The slide column 40 is inserted through the latch segment 42 and is threaded into the cam segment 60. The slide column 40 also fits within the lower check valve segment 10. Above the lower check valve segment are the nozzle segment 66, the drive fluid injection segment 76, the venturi pump segment 96, the upper check valve segment 24, and the nipple end segment 114, to complete the pump.

The cross-over nipple is run into the oil well with a production string packer 138 held in place below the cross-over nipple. The entire production string is installed. The production string is broached to ensure that the pump would be able to be installed in place. The pump is assembled and is inserted within the cross-over nipple using a wire line and the fishing assembly. The weight of the sinker bar ensures adequate striking force to force the pump down over the slide assembly and cam segment. As this is done, the latches open and lock the pump in place. In place, the inlet slots 126 in the cross-over nipple 118 align with the slots 86 in the drive fluid injection segment 76. These slots provide access for high pressure fluid into the pump from outside the cross-over nipple as described in more detail with regard to FIG. 2.

Figure 2:
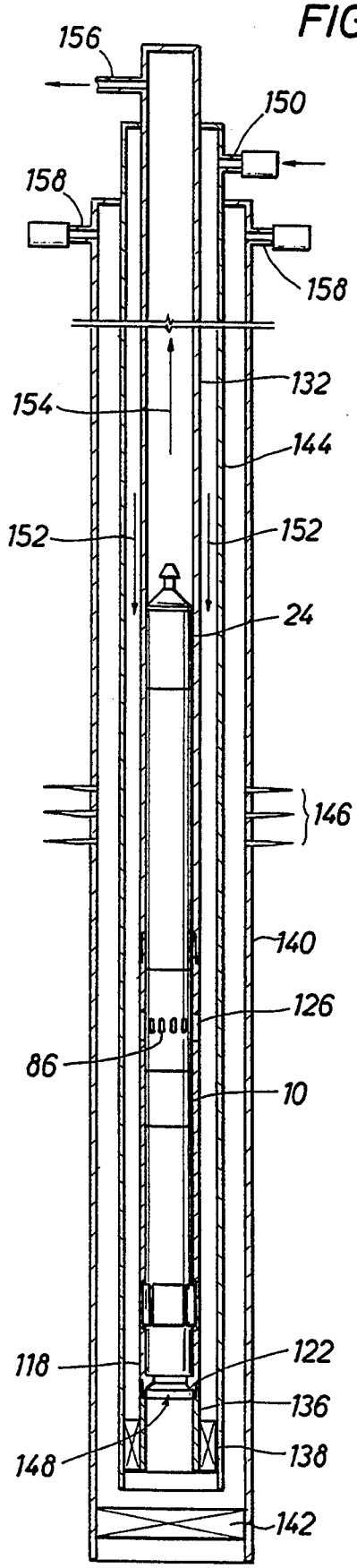
FIG. 2 depicts the section view of FIG. 1 and further showing supply and discharge paths of drive fluid and produced fluid in a working pump.

FIG. 2 depicts the assembled pump in a cross-over nipple on the end of a production string 132 in its working environment down hole. The cross-over nipple 118 supports a nipple 136 that carries a production string packer 138. A bore hole is normally lined with a casing 140 (normally about 7" in diameter) that is cemented in place. The casing is sealed off at the bottom with a plug 142. As shown in FIG. 2, an intermediate casing 144 (normally about 4½" in diameter) is placed between the casing 140 and the production string 132. Thus, the production string packer 138 seals between the nipple 136 and the intermediate casing 144. In this way, production fluid from a plurality of perforations 146 is drawn into a suction 148 of the pump 130.

A high pressure supply line 150 provides drive fluid to actuate the pump. As shown in FIG. 2, the drive fluid flows down between the intermediate casing 144 and the production string 132 as shown by arrows labeled 152. The drive fluid then enters the pump through slots 126 and 86, and into the annulus between the taper nozzle 74 and the nozzle opening 88. This annular flow creates a low pressure region above the taper nozzle 74 that draws production fluid from the surrounding formation, into the pump, and up into the Venturi pump segment 96. This arrangement takes advantage of a natural phenomenon known as the *Vena Contracta* and the end of the taper nozzle 74 is placed within the region of the *Vena Contracta*, the point at which the velocity of the drive fluid is greatest (creating a region of correspondingly minimum pressure). With the nozzle 74 thus placed, the lift capability of the pump of the present invention is maximized.

The drive fluid and production fluid mix and are discharged up out of the pump 130 into the production string, as shown by the arrow labeled 154. From there the drive/production fluid mixture is discharged from the production well through a discharge line 156. FIG. 2 also shows lines 158 which may be used for the conduct of liquid level and pressure tests within the annulus between the production casing and the intermediate casing, or other tests.

Before the pump of the present invention is placed down hole, the bore hole is lined with production casing 140 (FIG. 2) cemented in place. The production casing is penetrated in some fashion, such as by perforations, installation of a slotted liner, (or the like) to permit fluid communication between the geologic zone from fluid to be produced (the production zone) and the interior of the production casing. Within the production casing 140 and to a point below the production zone is an intermediate casing 144 that has been pressure tested to ensure integrity of the intermediate casing and its fittings.

A production string with the cross-over nipple 118 and the production string packer 138 attached, is run down-hole to the bottom of the intermediate casing and the packer is set. Next a tubing broach is run to the bottom of the production string. The annulus between the intermediate casing and the production string is flushed with clean liquid such as oil or water. The production string is then pressure tested for leaks.

The pump of the present invention is then run to the bottom of the production string using a wire line. When the bottom of the pump (i.e., the cam segment 60) comes into contact with the bottom ledge 134 of the cross-over nipple 118, the pump slides down the slide column 40, the latches 52 open as the pump is forced downward on the cam segment 60, and the latches expand into the recess 128 of the cross-over nipple 118 to hold the pump in place.

FIG. 13 depicts a fishing tool 160 adapted to retrieve the pump of the present invention from down hole. The fishing tool 160 comprises generally a head cap 162, a sinker 164, and a fishhook section 166. The head cap 162 is adapted to easily receive a fishing line 168, such as piano wire, strong enough to support the fishing tool 160 and pump 130 combination and enough excess strength to withstand forces sufficient to unlatch the latch segment 42 from the recess 128 in the cross-over nipple 118. The fishing line 168 terminates in a stopper 170 FIGS. 13B and 13C which is easily inserted and withdrawn from the head cap 162. The piano wire is fed through a hole in the head cap 162. The piano wire is slipped through the groove 172 of the stopper (FIGS. 13B and 13C). The piano wire is tied by twisting the wire at the top of the stopper after looping it through the groove 172. By this way, the greater the pull on the wire line, the greater would be the force to prevent it from coming loose in the stopper. After the stopper with the piano wire line has been assembled, the head cap 162 is screwed onto the sinker 164 at a set of threads 174.

The sinker 164 is preferably a solid cylinder of lead, heavy enough to easily carry the fishing tool down hole. In a preferred embodiment, the sinker is solid lead about 8 feet long and about 1.9 inches is diameter. The sinker 164 couples to the fish hook 166 by a threaded connection 176.

The fish hook 166 includes a plurality of hinges 178, also shown in an end view in FIG. 13A. Each hinge 178 supports a hook element 180, and each hook element terminates in a barb 182. The barbs 182 serve to grasp a nipple end 184 of the nipple end segment 114. Further, the hook elements 180 are spring loaded with springs 186 to firmly grasp the nipple end.

The fishing tool is preferably used to run the pump of the present invention down hole since it has sufficient mass to force the latches open to hold the pump in place.

The principles, preferred embodiment and mode of operation of the present invention have been described in the foregoing specification. This invention is not to be construed as limited to the particular forms disclosed, since these are regarded as illustrative rather than restrictive. Moreover, variations and changes may be made by those skilled in the art without deporting from the spirit of the invention.

I claim:

1. A down-hole insert pump configured to be positioned on the end of a production string of pipe and within an annulus between the production string of pipe and an intermediate casing, the pump comprising:

a. a tapered nozzle with an inlet end for receiving production fluid and a discharge end for discharging production fluid;

b. a drive fluid injection segment for receiving drive fluid from the annulus into an annular inlet chamber with a plurality of radial penetrations into a region between the tapered nozzle and the drive fluid injection segment, the penetrations substantially surrounding the region, the drive fluid injection segment surrounding the tapered nozzle to form a drive nozzle that creates a *Vena Contracta* at the discharge end of the tapered nozzle;

c. a venturi segment coupled to the drive fluid injection segment to receive drive fluid and production fluid and to develop a low pressure region of the combined drive and production fluids; and d. a nipple end segment coupled to the pump and configured to be remotely seized by a fishing tool.

2. The pump of claim 1 further comprising a check valve at the inlet of the tapered nozzle.

3. The pump of claim 1 further comprising a cross-over nipple surrounding the tapered nozzle, the drive fluid injection segment, and at least a portion of the venturi segment.

4. The pump of claim 3 wherein the crossover nipple defines a recess and further comprising a latch segment adapted to expand into the recess.

5. The pump of claim 3 wherein the crossover nipple fits on the end of a production string of pipe.

6. The pump of claim 3 wherein the crossover nipple is sized to fit within an intermediate casing and further comprising a packer to seal between the crossover nipple and the intermediate casing.

7. The pump of claim 1 further comprising a check valve coupled to the venturi segment.

8. The pump of claim 1 further comprising a nipple end segment configured to be remotely seized by a fishing tool.

9. The pump of claim 1 further comprising a seal between the pump and a production string.

10. A method of pumping from a production structure with an insert pump comprising the steps of:

a. coupling a production fluid flow path between a production structure and the inlet to a tapered nozzle;

b. injecting a high pressure drive fluid through a fluid flow path between an intermediate casing and a production string of pipe into an annular inlet chamber and from there through a plurality of penetrations substantially surrounding the tapered nozzle into a region between the tapered nozzle and a nozzle opening to create a *Vena Contracta* at the tip of the tapered nozzle; and c. combining the production fluid and the drive fluid in a venturi; and d. upon completion of pumping, using a fishing tool to seize a nipple end segment coupled to the pump.

11. Apparatus for pumping fluid from a down-hole geologic structure comprising:

a. a well casing down to the structure and having an opening to the structure;

b. an intermediate casing within the well casing;

c. a production string within the intermediate casing;

d. a crossover nipple coupled to the production string, the crossover nipple defining an interior recess;

e. an insert pump at least partially within the cross-over nipple comprising:

i. a tapered nozzle with an inlet end for receiving production fluid and a discharge end for discharging production fluid;

ii. a drive fluid injection segment for receiving drive fluid, the drive fluid injection segment surrounding the tapered nozzle to form a drive nozzle that creates a *Vena Contracta* at the discharge end of the tapered nozzle;

iii. a venturi segment coupled to the drive fluid injection segment to receive drive fluid and production fluid and to develop a low pressure region of the combined drive and production fluids; and iv. a latch segment coupled to the tapered nozzle adapted to releasably latch the pump within the recess in the crossover nipple;

f. a packer to seal between the crossover nipple and the intermediate casing; and g. a nipple end segment coupled to the pump and configured to be remotely seized by a fishing tool.

12. The apparatus of claim 11 further comprising a check valve at the inlet of the tapered nozzle.

13. The apparatus of claim 11 further comprising a check valve coupled to the venturi segment.

14. The apparatus of claim 11 further comprising a seal between the pump and the production string.

* * * * *

UNITED STATES PATENT AND TRADEMARK OFFICE

CERTIFICATE OF CORRECTION

PATENT NO. : 5,374,163

DATED : December 20, 1994

INVENTOR(S) : Allan Jaikaran

It is certified that error appears in the above-indentified patent and that said Letters Patent is hereby corrected as shown below:

Column 4, line 10, delete the phrase "secondary recovery" and insert therefor the phrase - artificial lift --.

Signed and Sealed this

Sixth Day of June, 1995

*Attest:*

*Attesting Officer*

BRUCE LEHMAN

*Commissioner of Patents and Trademarks*